United States Patent [19]

Völkle

[11] Patent Number: 4,693,514

[45] Date of Patent: Sep. 15, 1987

[54] CHAIR HAVING A CLAMPING DEVICE FOR ADJUSTING THE INCLINATION OF THE BACK AND/OR SEAT

[76] Inventor: Rolf Völkle, Siemensstrasse 2, D-7298 Lossburg, Fed. Rep. of Germany

[21] Appl. No.: 857,749

[22] PCT Filed: Jul. 8, 1985

[86] PCT No.: PCT/DE85/00235

§ 371 Date: Mar. 10, 1986

§ 102(e) Date: Mar. 10, 1986

[87] PCT Pub. No.: WO86/00508

PCT Pub. Date: Jan. 30, 1986

[30] Foreign Application Priority Data

Jul. 10, 1984 [DE] Fed. Rep. of Germany ..... 3425387

[51] Int. Cl.[4] ..... A47C 1/024

[52] U.S. Cl. ..... 297/374; 297/320; 297/355

[58] Field of Search ..... 297/374, 316, 320, 311, 297/312, 322, 375, 354, 355

[56] References Cited

U.S. PATENT DOCUMENTS 2,903,046 9/1959 Repaich ..... 297/322
3,989,297 11/1976 Kerstholt ..... 297/312 X

FOREIGN PATENT DOCUMENTS 936353 12/1955 Fed. Rep. of Germany .
2927377 1/1981 Fed. Rep. of Germany .
390949 4/1933 United Kingdom .

*Primary Examiner*—Kenneth J. Dorner
*Assistant Examiner*—Mark W. Binder
*Attorney, Agent, or Firm*—Spencer & Frank

[57] ABSTRACT

It is possible to lock the inclination of the back of a seat by the locking device by means of a strip friction connection. The locking device is arranged as a modular unit with an axial motion by means of friction connection disk (13*a*) in bearings (10*a*) of the seating. A self-locking eccentric (17) bearing by its pivoting axis (16) on the tension rod (14) and with an extremely small rise of its eccentric curve is frontally engaged with the assembly of friction connection disks (13). Thus, part of the handling resistance of the eccentric is considerably reduced due to the small rise of its eccentric curve and on the other hand, due to a shortening, characteristic of the system, of the pivoting travel of the eccentric (17), said travel being still sufficiently short.

12 Claims, 8 Drawing Figures

CHAIR HAVING A CLAMPING DEVICE FOR ADJUSTING THE INCLINATION OF THE BACK AND/OR SEAT

The invention relates to a chair as defined in the preamble of claim 1.

In a known chair of this type (DE-PS No. 2,927,377) the clamping device is axially supported at the seat or the seat carrier at which the lever for shifting the friction lock is also mounted. The laminar friction lock is controllable with the aid of the twin-arm lever design and the cooperation of tensionable spring washers. The friction lock is here produced and maintained by the spring washers. Such a clamping principle is therefore relatively expensive to produce. To release the friction lock, the spring washers are compressed by means of the actuation lever until the friction lock is released. This requires a relatively large path for the pivot movement of the lever.

A chair is also known which has a comparable clamping device (DE-OS No. 2,335,586, FIG. 2*a*) where the laminar friction lock is established without the aid of spring means but with the aid of an eccentric. In this case, however, the clamping device, which is asymmetrically arranged with respect to the plane of symmetry of the chair, is likewise axially supported at the seat or the seat carrier. Since such a clamping device requires that the eccentric be self-locking, the rise of the eccentric curve, when the eccentric engages at the frontal face of the clamping bolt, is of necessity relatively small. This small rise requires, on the one hand, less operating resistance, on the other hand, a relatively long pivot path for actuation of the eccentric.

In the known clamp mechanisms, the eccentric is always supported by a stationary portion of the chair. Therefore, the axial movement required to establish or release the laminar friction lock is effected exclusively by the axial thrust of the nonstationary (driving) part of the eccentric which must be designed for a correspondingly long thrust.

It is the object of the invention to modify a seat of the above-mentioned species so that, with favorable conditions for economic mass production, the pivot path of the lever for operating the eccentric is shortened and thus manual control the clamping device is facilitated.

This is accomplished by the invention with the features defined in the characterizing portion of claim 1.

In such a configuration, the relative movement between the clamping bolt and the adjacent friction lock discs produced by actation of the eccentric is converted into a simultaneous, but oppositely directed axial movement of the friction lock discs and laminae disposed on one side of the plane of symmetry a—a and the friction lock discs and laminae disposed on the other side of this plane of symmetry. The friction lock discs and laminae on the side of the eccentric are pushed toward the plane of symmetry. The friction lock discs and laminae disposed on the other side of the plane of symmetry, however, are pulled toward this plane of symmetry. This results in a shorter pivot path for the eccentric whose pivot axis is fixed to the clamping bolts and whose eccentric curves (eccentric discs) lie at the packet of friction lock discs. An approximately symmetrical construction of the clamping device arranged symmetrically to the plane of symmetry is beneficial for mass production.

The invention will be described below with reference to three embodiments and the drawing.

It is shown in:

FIG. 1, a top view of the stationary seat of the chair with the seat shell removed and an adjustable-inclination support for the back rest;

FIG. 2, a bottom view of the seat,

FIG. 3, an enlarged sectional view along line III—III of FIG. 1 of the seat according to FIGS. 1, 2;

FIG. 3*a*, an enlarged sectional view along line III*a*—III*a* of FIG. 1 of the seat according to FIGS. 1, 2;

A further embodiment [is shown in] FIGS. 4–6, 6*a*.

Figure 1:
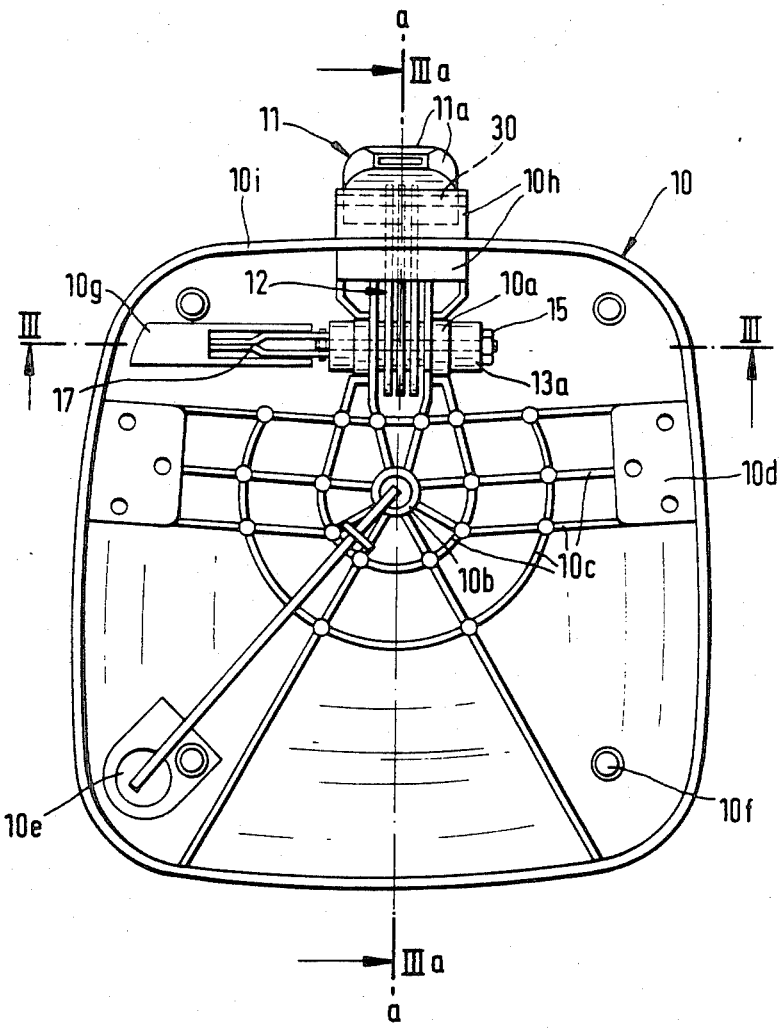
Figure 2:
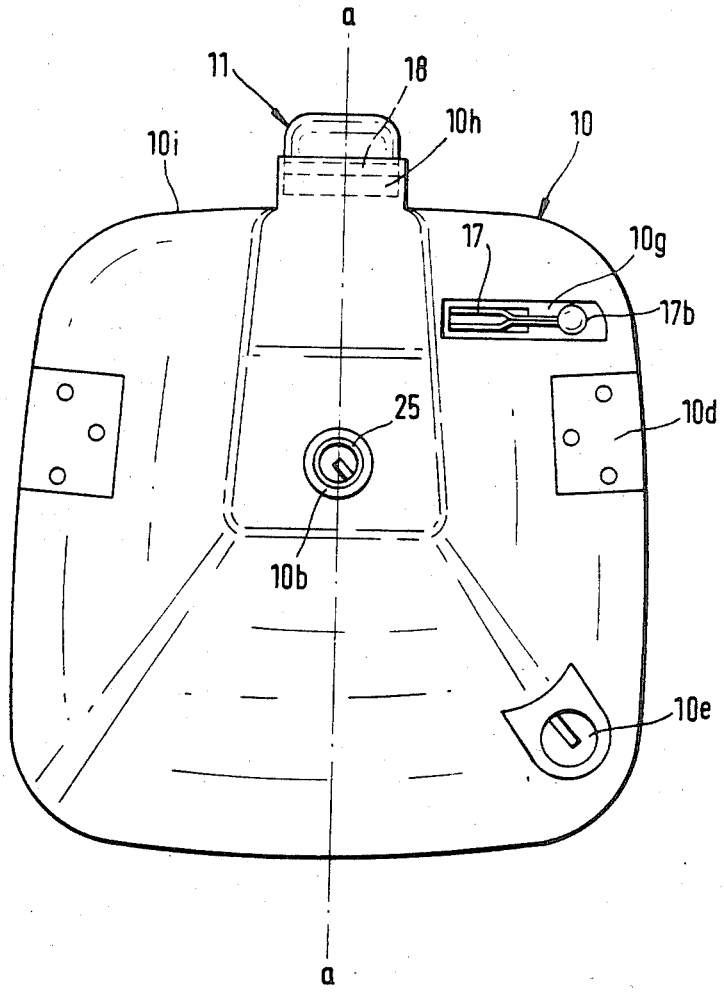
Figure 3:
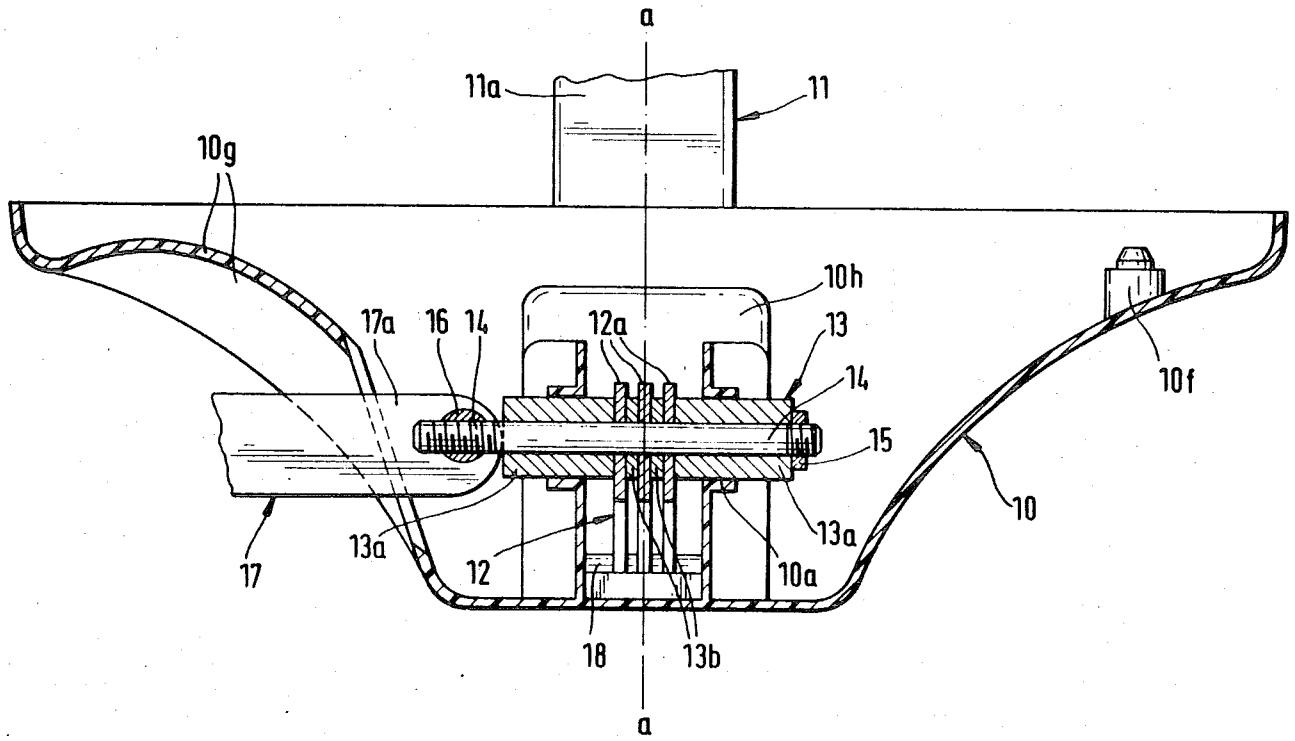
Figure 3A:
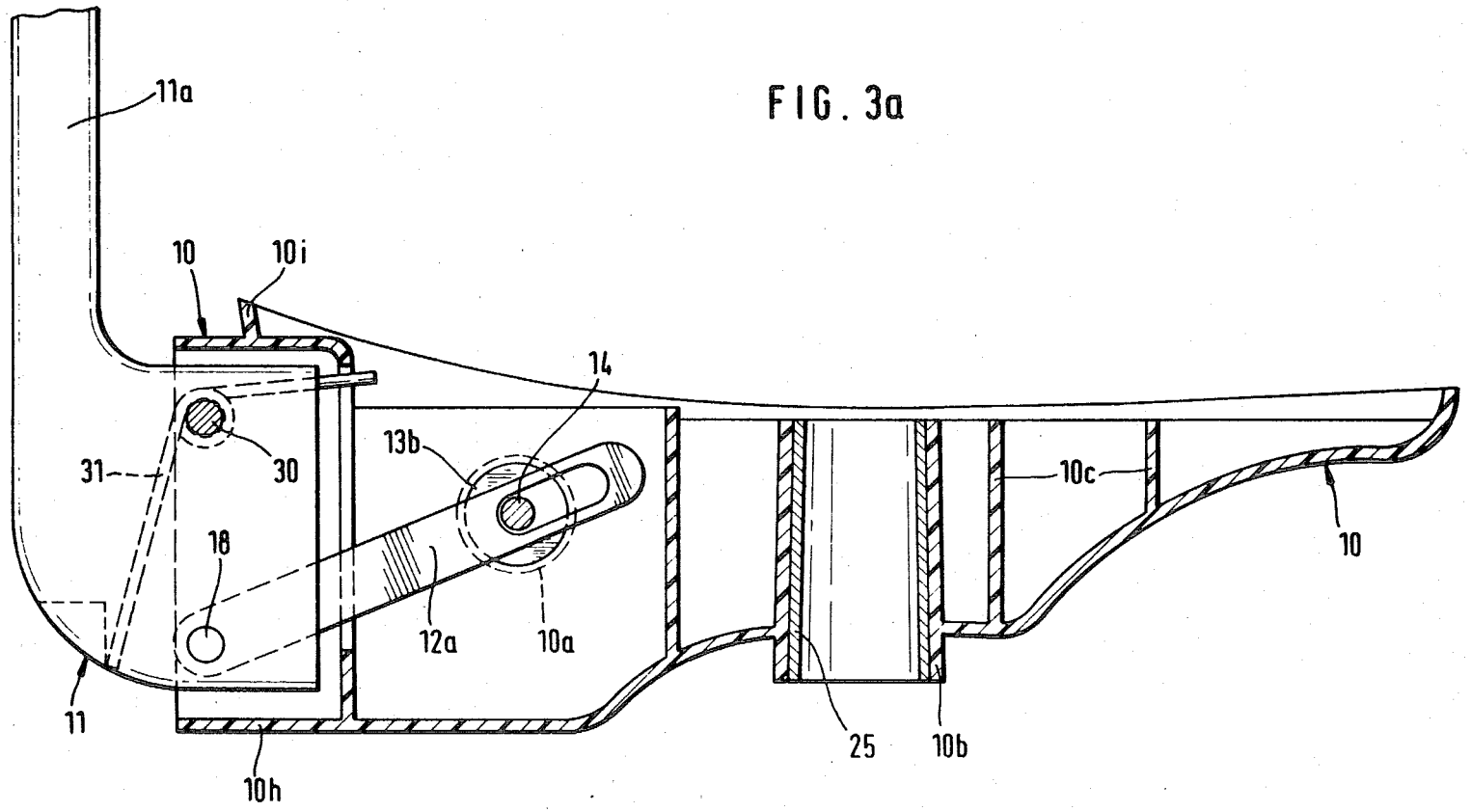
Figure 4:
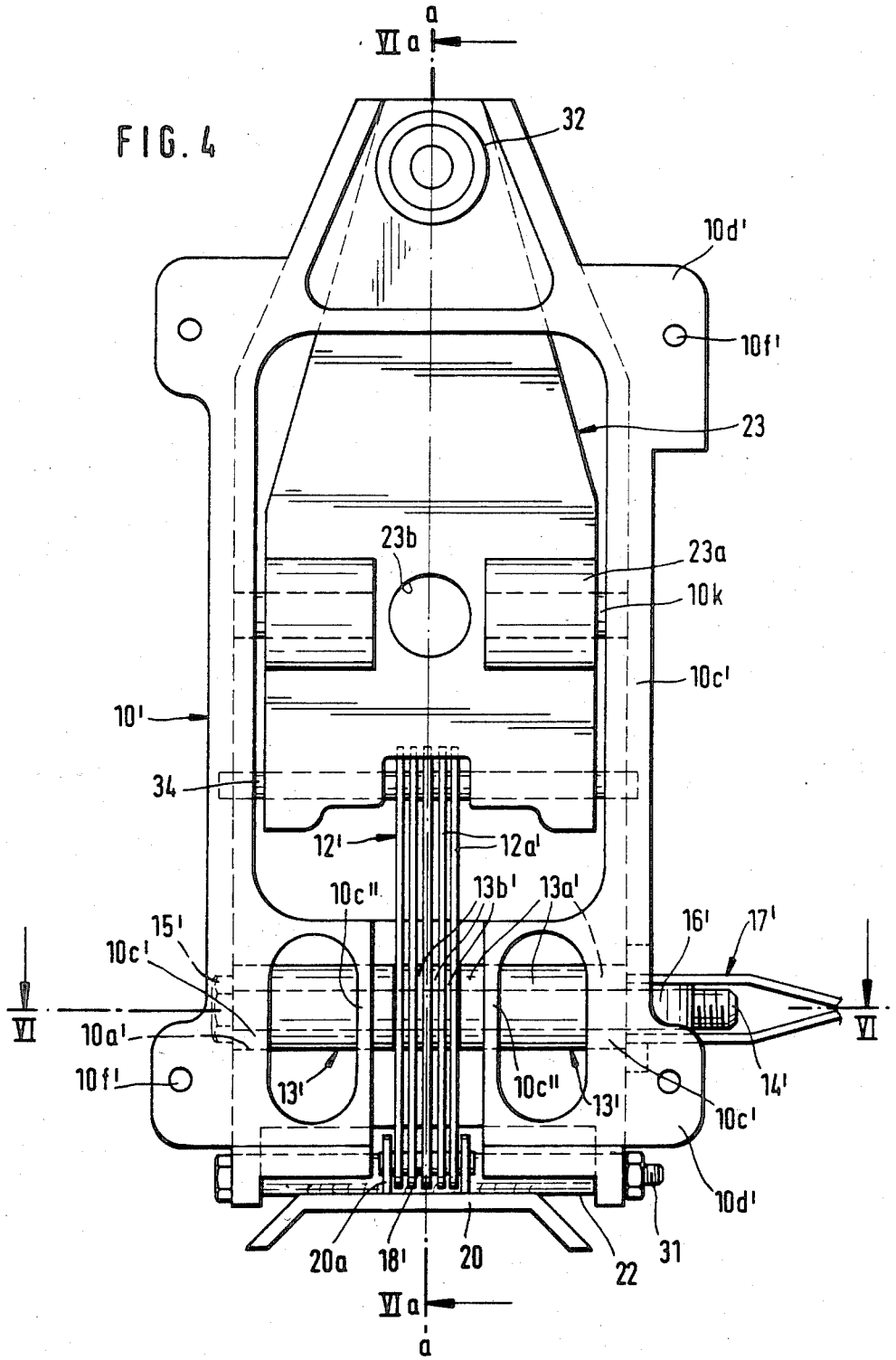
FIG. 4, is a top view of the seat without set shell of the chair having an adjustable-inclination support for the back rest.
Figure 6:
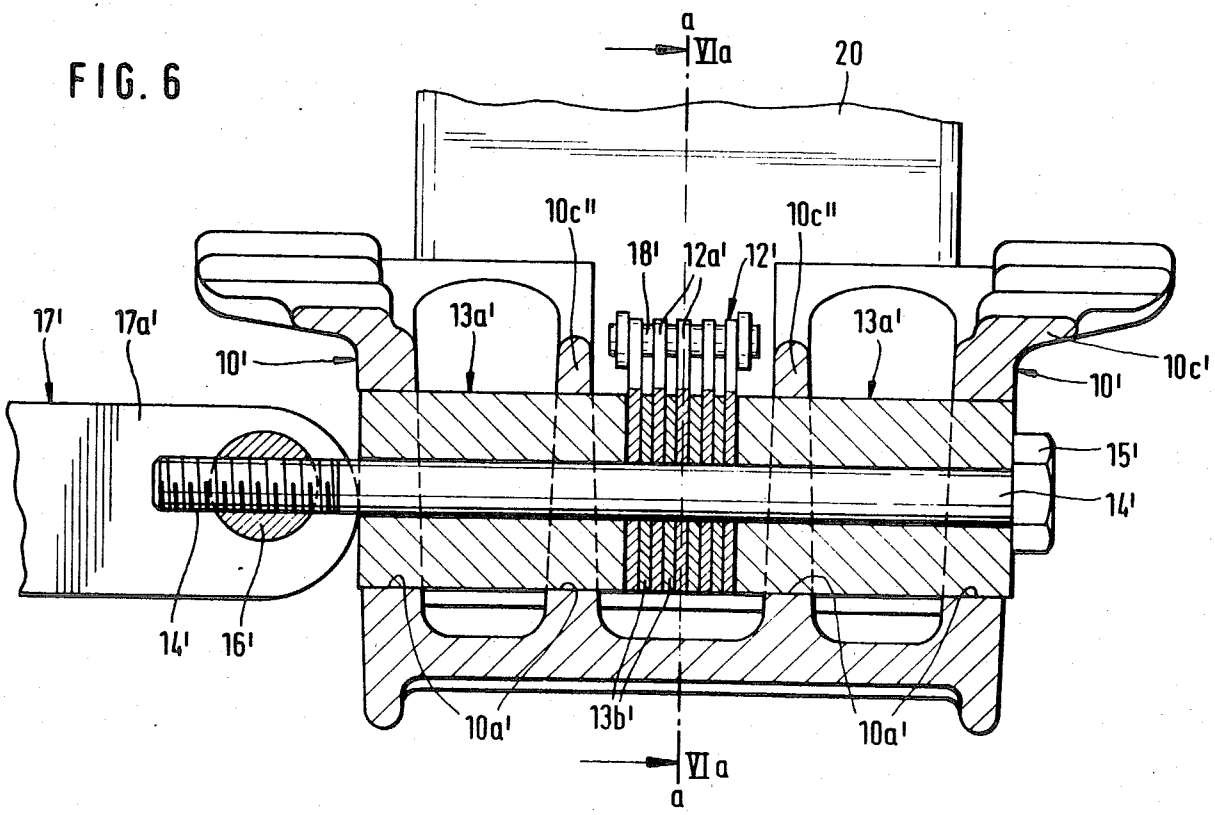
FIG. 6 is a sectional view along line VI—VI of FIG. 4 of the seat of FIG. 4.
Figure 6A:
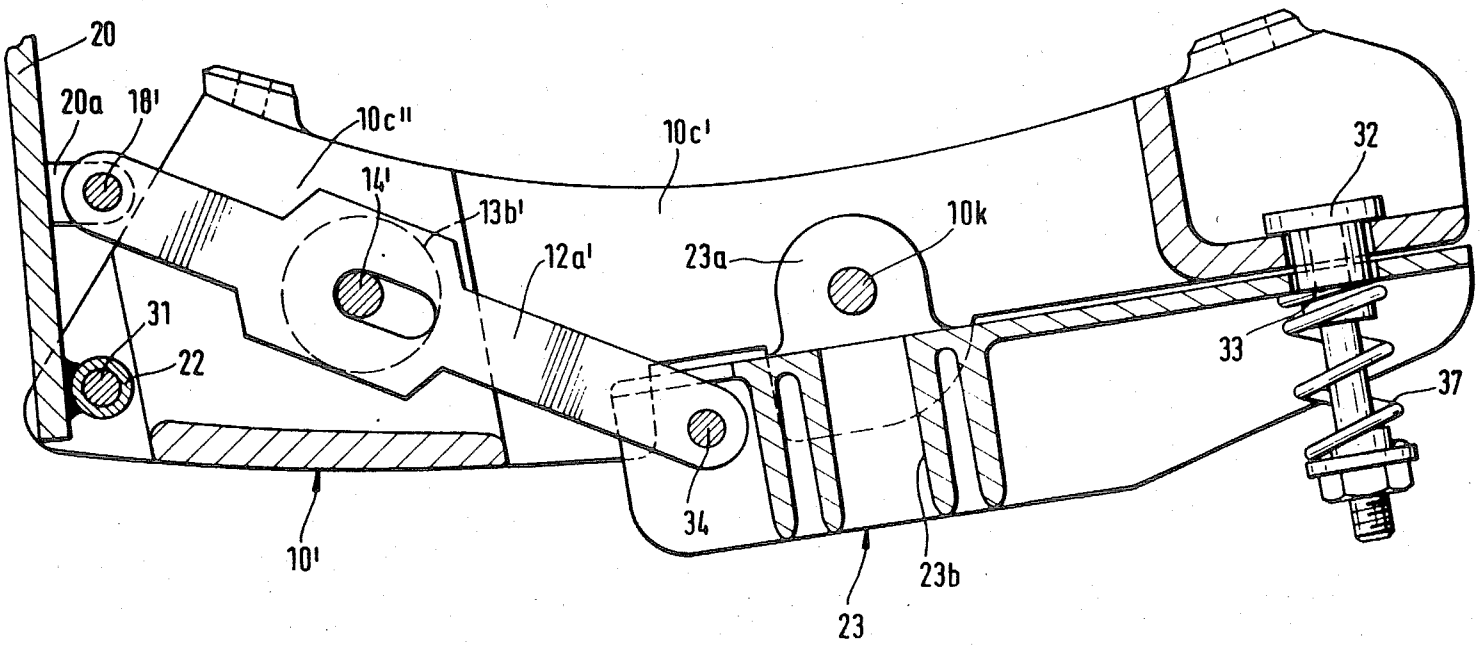

FIG. 6*a* is a sectional view along line VI*a*—VI*a* of FIG. 4 of the seat of FIG. 4.

In both embodiments, the clamping device is accommodated in support bearings 10*a*;10*a*′ contained in vertical ribs arranged approximately symmetrically with respect to the plane of symmetry a—a of the chair. The clamping device includes packet (packet of laminae 12;12′) of laminae 12*a*;12*a*′, which are articulated to the back rest and/or the seat support. The clamping device further includes a packet (friction lock disc packet 13;13′) of coaxial friction lock discs 13*a*;13*a*′ whose friction locking faces lie against the laminae. Also a clamping bolt 14;14′ which penetrates the laminae through long holes as well as the friction lock discs and the ribs accommodating the clamping device. Finally, the clamping device includes a manually actuatable eccentric 17,17′ for controlling the clamping device by means of relative displacement (friction lock shift) between clamping bolts 14,14′ on the one hand, and the packet of laminae and the friction lock disc packet 13,13′ on the other hand. It is significant that the clamping device, as a structural unit, is accommodated in support bearings 10*a*;10*a*′ so as to be axially movable and is retained in the axial position by the packet of laminae.

This axial mobility is assured by the given lateral play of laminae 12*a*;12*a*′. Thus it is possible, with friction lock shifting, for friction lock disc packet 13;13′ (at which eccentric discs 17*a*;17*a*′ engage) and clamping bolt 14;14′ (in which the pivot axis 16;16′ of the eccentric is mounted) to move simultaneously in the axial direction. As a result of this simultaneous movement, the pivot path of the actuating lever 17*b*;17*b*′ is cut approximately in half. The lever which is mounted in the clamping bolt by means of its pivot axis 16;16′ and engages at the front face of the friction lock disc packet is configured as a self-inhibiting eccentric 17;17′. The term "self-inhibiting eccentric" in the above sense is understood to mean an eccentric whose eccentric curves engage at friction lock disc packet 13; 13′ with such a flat slope angle that, due to the friction forces active between the eccentric curves and the front face of the friction lock disc packet, the eccentric is unable to release itself. The packet of friction lock discs 13;13′ has such a configuration and arrangement that its plane of symmetry which is perpendicular to its axis approximately coincides with the plane of symmetry a—a of the chair. This results in an approximately symmetrical arrangement of the clamping device with respect to the plane of symmetry a-a. In this symmetrical position, the clamping device, in spite of its axially movable position, is retained approximately in the support bearings by the laminae 12*a*;12*a*′ which are articulated at one or both ends at a hinge axis. Finally, in both embodiments the pivot axis 16;16′ of the eccentric 17;17′ is configured as a cylindrical bearing bolt which is perpendicular to the clamping bolt and has a bore through which the clamping bolt penetrates it. The bearing bolt is in communication with the clamping bolt 14;14′ by means of an internal thread in its bore. Eccentric 17;17′ includes two eccentric discs 17*a*;17*a*′ which are mounted at the free ends of the bearing bolt which serves as pivot axis 16;16′. Support bearings 10*a*;10*a*′ disposed on one side of the plane of symmetry a—a are each penetrated by a single friction lock disc 13*a*;13*a*′. Compared to friction lock discs 13*b*;13*b*′, which are disposed in the region between laminae 12*a*;12*a*′, friction lock discs 13*a*;13*a*′ have much larger dimensions in the axial direction in the region of support bearings 10*a*;10*a*′. All support bearings 10*a*;10*a*′ are part of a single cast piece which, in the embodiment according to FIG. 1–3, 3*a* is an injection molded plastic member and, in the embodiment according to FIGS. 4–6, 6*a*, a cast aluminum member.

For the embodiment of FIGS. 1–3, 3*a* the following applies: the seat is formed of a supporting shell 10 and an approximately congruent seat shell (not illustrated) which is mounted on this supporting shell. The seat shell rests on the edge of supporting shell 10 and is additionally supported and centered on the supporting column 10*f* of supporting shell 10. In the interior of supporting shell 10, there are numerous reinforcement ribs 10*c* which are symmetrical to the plane of symmetry a—a. Sleeves are shaped to two vertical reinforcement ribs extending parallel to this plane of symmetry a—a so as to form the support bearing 10*a* for the clamping device. Fastening faces 10*d* accommodate the supports for the arm rests. Openings 10*e* serve to guide the actuation member for the height adjustment of the seat. The upwardly oriented recess 10*g* in the bottom of supporting shell 10 provides a free space for pivoting eccentric 17. The approximately vertical rear edge 10*i* defines an approximately block-shaped housing member 10*h* which is open at the rear. In this part of the housing, a support 11 formed by a hollow, ejection molded plastic member, is defined by means of pivot axis 30 and is pivotally mounted. The ejection molded plastic member ends in an approximately perpendicular sleeve 11*a* which is suitable to receive the support arm for the back rest. A reset spring 31 imparts a tendency to the back rest of inclining it toward the back of the user of the chair and the user imparts the desired inclination to the back rest by correspondingly leaning against it. The hinge axis 18 is spaced from pivot axis 30 and is mounted parallel to pivot axis 30 in carrier 11. The seat and thus also seat shell 10 are placed rigidly onto the central supporting spindle of the chair. For this purpose, a sleeve 10*b* is shaped into seat shell 10 which itself is lined by a metal bush 25. Seen from a function point of view, the support shell 10 is thus simultaneously the support for the seat and accommodates the seat in the form of the seat shell.

In the embodiment of FIGS. 4–6, 6*a*, the seat is defined by a supporting frame 10′ and a seat shell (not illustrated). The latter is supported on support faces 10*d*′ of the support frame and is connected therewith by means of fastening members 10*f*′. Frame sections of supporting frame 10′ extending parallel to the plane of symmetry a—a are each provided with two reinforcement ribs 10*c*′;10*c*″, which likewise extend parallel to the plane of symmetry a—a. Support bearings 10*a*′ for the clamping device are formed by coaxial bores in these reinforcing ribs 10*c*′;10*c*″. The thin reinforcing ribs 10*c*″ (FIGS. 4, 6) extend close to the plane of symmetry a—a. The hinge axis 18′ is accommodated in lugs 20*a* of support 20 for the back rest which is articulated, with the aid of a bearing sleeve 22, at an axis 31 of supporting frame 10′. With the aid of its pivot bearings 10k, supporting frame 10′ is pivotally connected with seat support 23. Pivot bearings 10*k* are accommodated in bearing sleeves 23*a* which are shaped to seat supported 23. Seat support 23 is accommodated, via central bore 23*b*, by the supporting spindle of the foot rest. The inclination of the seat can be set by the user of the chair by appropriately displacing the center of gravity against the force of a reset spring 37 which is supported at one end, at 32 on supporting frame 10′ and at the other end, at 33, at the not pivotal seat support 23 at 33. As can be seen in FIG. 4, the bores in ribs 10*c*′ and 10*c*″ are penetrated at each side of the plane of symmetry by a single friction lock disc 13*a*′. Laminae 12*a* of the packet of laminae 12′ are articulated, one the one hand, at a hinge axis 34 of seat support 23 and, on the other hand, at hinge axis 18′ of the back rest. The spatial association of hinge axes 18′, 34 and clamping bolt 14′ is such that a change in inclination by means of the clamping device results in a displacement ratio between seat 23 and back rest of about 1:2.

In both embodiments, the clamping bolt is supported at friction lock disc packet 13,13′ by means of a screw nut 15;15′.

Figure 5:
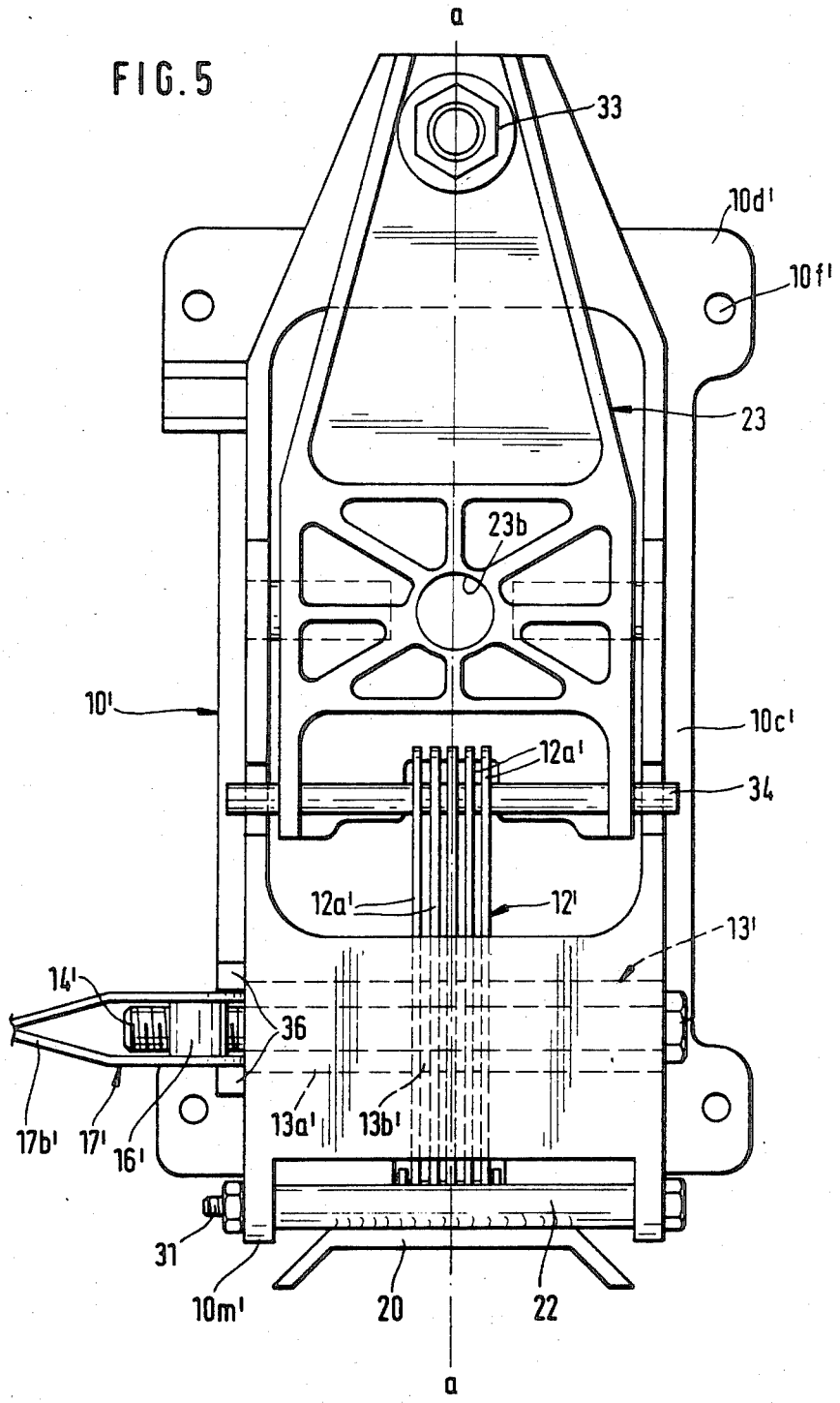
FIG. 5 is a bottom view of the seat according to FIG. 4.

Eccentric and clamping bolt are secured against rotation on supporting frame 10′ by means of ribs 36 (FIG. 5).

I claim:

1. Chair, particularly a roatable office chair, having a foot rest which includes a central supporting spindle, seat means (10, 23) carried by the support spindle and having vertical ribs (10*c*;10*c*′;10*c*″) formed to define support bearings (10*a*;10*a*′) which are located at least approximately symmetrically to the plane of symmetry of the chair, a back rest carried by the seat means, and a clamping device supported in the bearings and connected to at least one of the seat means and back rest for adjusting the inclination of at least one of the seat means and back rest by laminar friction, said clamping device being composed of: a packet (12,12′) of laminae (12*a*;12*a*′) which are provided with elongated holes and are articulated to at least one of the seat means and back rest; a friction lock disc packet (13;13′) of annular, coaxial friction lock discs (13*a*;13*b*;13*a*′;13*b*′) having friction locking faces which lie against the laminae (12*a*;12*a*′); a clamping bolt (14;14′) which passes through the laminae and discs; and a manually actuable lever operatively associated with the clamping bolt for effecting relative displacement between the clamp bolt and the laminae and discs in order to control the clamping of the laminae between the discs; characterized in that;

said friction lock discs are movably mounted in said support bearings, so that said clamping device is movable in the direction of the axis of said clamping bolt;

the plane of symmetry of the chair passes throgh said packet of laminae and said friction lock disc packet; and said lever constitutes a self-inhibiting eccentric having a pivot axis fixed to said clamping bolt and bears against one end of said friction lock disc packet such that pivotal movement of said lever about its pivot axis causes axial displacement of said clamping bolt and causes the parts of said packet of laminae and friction lock disc packet which are respectively opposite sides of the plane of symmetry of the chair to move in respectively opposite directions.

2. Chair according to claim 1, characterized in that the friction lock disc packet (13;13') is disposed approximately symmetrically to the vertical plane of symmetry (a—a) of the chair.

3. Chair according to claim 13, characterized in that said lever includes a cylindrical bearing bolt which is perpendicular to the clamping bolt (14;14'), defines the pivot axis of said lever and has an internaly threaded bore in which said clamping bolt is fixed.

4. Chair according to claim 1, characterized in that the eccentric (17;17') includes two eccentric discs (17*a*;17*a'*) whose eccentric curves engage at the frontal face of the adjacent friction lock disc (13; 13*a'*) and through which penetrate the free ends of the pivot axis (16;16').

5. Chair according to claim 1, characterized in that the support bearings (10*a*;10*a'*) disposed on either side of the plane of symmetry (a—a) are each penetrated by a single friction lock disc (13*a*;13*a'*).

6. Chair according to claim 1, characterized in that all support bearings (10*a*;10*a'*) are components of a single cast piece.

7. Chair according to claim 6, characterized in that the cast member is an injection molded plastic member which supports a seat shell (not shown) that has the same basic outline as the seat (FIGS. 1–3, 3*a*).

8. Chair according to claim 7, characterized in that the support bearings (10*a*) are formed by sleeves which are shaped to vertical ribs of the injection moded plastic member.

9. Chair according to claim 7, characterized in that said chair further comprises a hinge having an axis and connecting said seat back to said seat means and the laminae (12*a*) of the clamping device, which serves exclusively for adjusting the inclination of the seat back are penetrated, at one end, by the hinge axis (18).

10. Chair according to claim 6, characterized in that said seat means comprise a seat support rigidly held by the support spindle and an adjustable-inclination support frame pivotally supported by said seat support, and said cast piece is produced by metal ejection molding, is made of aluminum, and forms said adjustableinclination support frame.

11. Chair according to claim 10, characterized in that the support bearings (10*a'*) are formed by bores in four vertical ribs of the cast member which are arranged symmetrically to the plane of symmetry (a—a) and each pair of bores on each side of the plane of symmetry (a—a) is penetrated by a single friction lock disc (13*a'*).

12. Chair according to claim 10, characterized in that said chair further comprises a hinge having an axis and connecting said seat back to said support frame, said laminae (12*a'*) are articulated, on the one hand, to the seat support (23) and, on the other hand, to the hinge axis (18') of the back rest in such a manner that, if the inclination is changed by means of the clamping device, a displacement ratio between the seat support (23) and back rest of about one to two results.

* * * * *